US006615416B1

(12) United States Patent
Chapman

(10) Patent No.: US 6,615,416 B1
(45) Date of Patent: Sep. 9, 2003

(54) PORTABLE TOILET OR POTTY FOR CHILDREN

(76) Inventor: David Keith Chapman, Joslin House, Hadley Green Road, Barnet, Hertfordshire (GB), EN5 5PP ( * ) Notice: Subject to any disclaimer, the term of this patent is extended or adjusted under 35 U.S.C. 154(b) by 0 days.

(21) Appl. No.: 09/141,637

(22) Filed: Aug. 28, 1998

(30) Foreign Application Priority Data

Aug. 29, 1997 (GB) ..... 9718213

(51) Int. Cl.[7] ..... H47K 11/06
(52) U.S. Cl. ..... 4/483
(58) Field of Search ..... 4/479, 481, 483

(56) References Cited

U.S. PATENT DOCUMENTS 186,264 A * 1/1877 Moore ..... 4/479

FOREIGN PATENT DOCUMENTS

| | | | | |
|---|---|---|---|---|
| AT | 236594 | * | 3/1964 | ..... 4/479 |
| CH | 96447 | * | 10/1922 | ..... 4/479 |
| DE | 25300 | * | 12/1883 | ..... 4/479 |
| GB | 22019 | * | of 1896 | ..... 4/481 |
| GB | 14047 | * | 4/1910 | ..... 4/481 |

* cited by examiner

*Primary Examiner*—Robert M. Fetsuga
(74) *Attorney, Agent, or Firm*—Haynes and Boone, LLP

(57) ABSTRACT

A potty comprises a base container, having a floor and a side wall extending upwardly from the floor, a removable seat having a rim which is supported on and sealed against the side wall of the base container and a recessed portion which extends partially into the base container, and a removable lid to cover at least the recessed portion of the seat. The recessed portion of the seat is formed with at least one aperture through which liquid may escape into the base container. The potty thus provides improved containment for liquid excreta by reducing the likelihood of spillage.

5 Claims, 2 Drawing Sheets

PORTABLE TOILET OR POTTY FOR CHILDREN

BACKGROUND OF THE INVENTION

1. Field of the Invention

The present invention relates to a portable toilet or potty for children, and particularly to a potty which may be used when travelling.

2. Related Background Art

Most portable toilets or potties for children consist of a one-piece moulded plastics bucket. A drawback of existing arrangements is that, once used, liquid excreta can easily be spilled from the potty, particularly if the potty is used in a moving vehicle. Furthermore, the majority of potties are not fitted with a lid and so, once used, do not contain the odour of their contents. The present invention seeks to provide an improved potty which overcomes the above-mentioned limitations of existing potties.

SUMMARY OF THE INVENTION

In accordance with the present invention, there is provided a potty comprising a base container having a floor and a side wall extending upwardly from the floor, a removable seat having a rim which is supported on and sealed against the side wall of the base container and a recessed portion which extends partially into the base container, the recessed portion of the base container being formed with at least one aperture through which liquid may escape from the recessed portion of the seat into the base container, and a removable lid to cover at least the recessed portion of the seat.

Preferably the lid covers the whole of the seat and is removably supported on and sealed against the side wall of the base container.

Preferably the floor of the base container is circular and the side wall of the base container is cylindrical. Preferably the rim of the seat is circular.

Preferably the floor of the base container comprises a raised portion which extends into the base container and upon which the recessed portion of the seat preferably rests, preferably such that the upper surface of the raised portion of the base container provides a floor for the recessed portion of the seat. It will be appreciated that the raised portion of the base container thus defines a channel between it and the side wall of the base container, within which channel liquid may be contained.

Preferably the base of the potty is provided with a coating of non-slip material.

Also in accordance with the present invention, there is provided a potty comprising a base container having a floor and a side wall extending upwardly from the floor, and a removable seat having a rim which is supported on the side wall of the base container and a recessed portion which extends partially into the base container, the recessed portion of the seat being formed with at least one aperture through which liquid may escape from the recessed portion of the seat into the base container.

BRIEF DESCRIPTION OF THE DRAWINGS

Embodiments of the present invention will now be described by way of examples only and with reference to the accompanying drawings, in which.

DETAILED DESCRIPTION OF THE PREFERRED EMBODIMENTS

Figure 1:
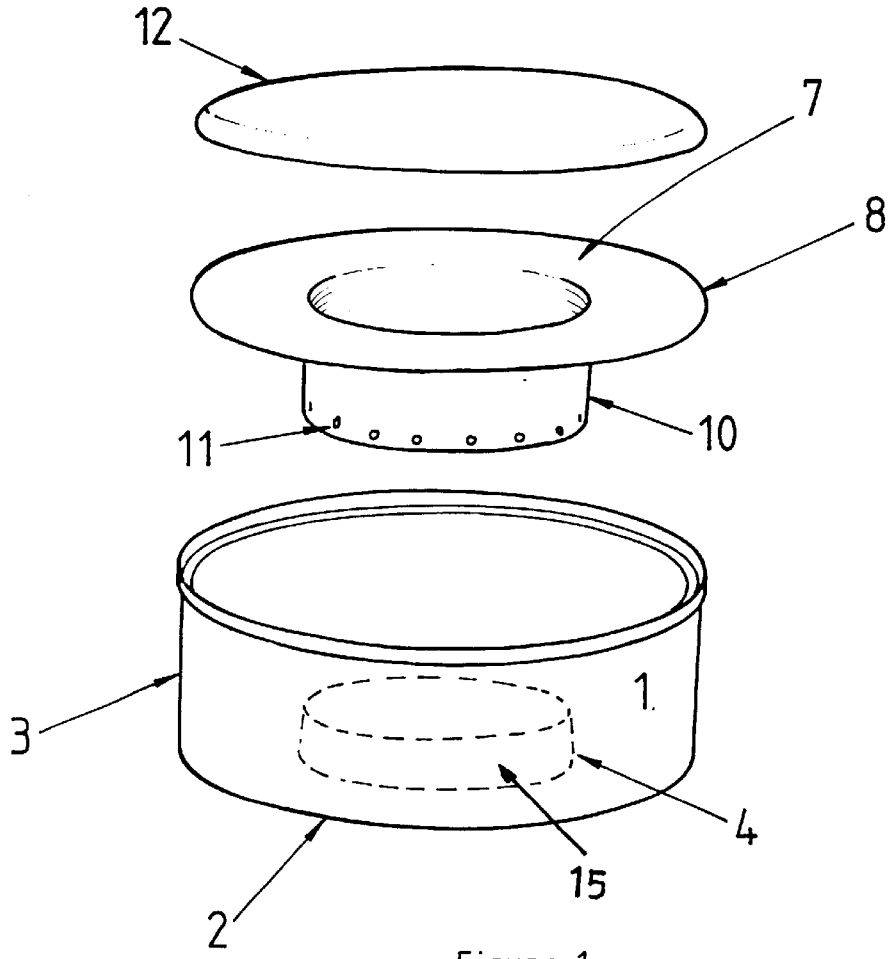
FIG. 1 is an exploded view of a first embodiment of potty in accordance with the present invention.
Figure 2:
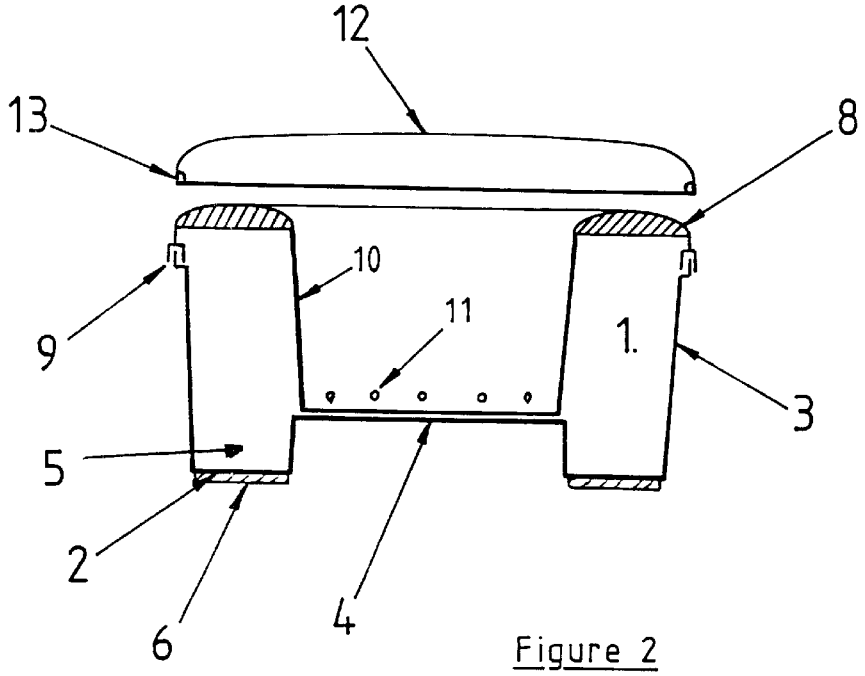
FIG. 2 is a cross-sectional view of the potty of FIG. 1.

Referring to FIGS. 1 and 2 of the drawings, a potty is shown comprising a base container 1 having a circular floor 2 and a cylindrical side wall 3. The floor 2 is formed with a raised portion 4, which defines a recess 15 within which items such as tissue paper may be stored. An annular channel 5 is also formed by the raised portion 4. The base container 1 is formed as a one-piece moulding and is provided with a non-slip coating 6 over the underside of its floor 2.

The potty also comprises a one-piece, moulded plastics seat 7, removably supported on the side wall 3 and having a circular rim 8 formed with a curved upper surface (similar to any conventional toilet seat). The outer edge of the rim 8 is formed with a U-shaped channel 9 for receiving the upper edge of the side wall 3. Depending from the rim 8 of the seat 7 is a recessed portion comprising a cylindrical side wall 10 having an open base. The side wall 10 of the recessed portion rests upon the upper surface of the raised portion 4 and is formed with a plurality of apertures 11 adjacent its base.

A one-piece moulded lid 12 is provided to cover the seat 7 and the base container 1, and is formed with an inwardly directed shoulder 13 to engage the outer edge of the U-shaped channel 9, to provide a seal.

In use, any liquid excreta entering the recessed portion of the seat 7 will drain through the apertures 11 and into the channel 5 formed between the raised portion 4 and the side wall 3 of the base container 1. If the potty is used in a moving vehicle, the liquid excreta will thereby be prevented from splashing out of the potty and onto the child or into the vehicle.

Figure 3:
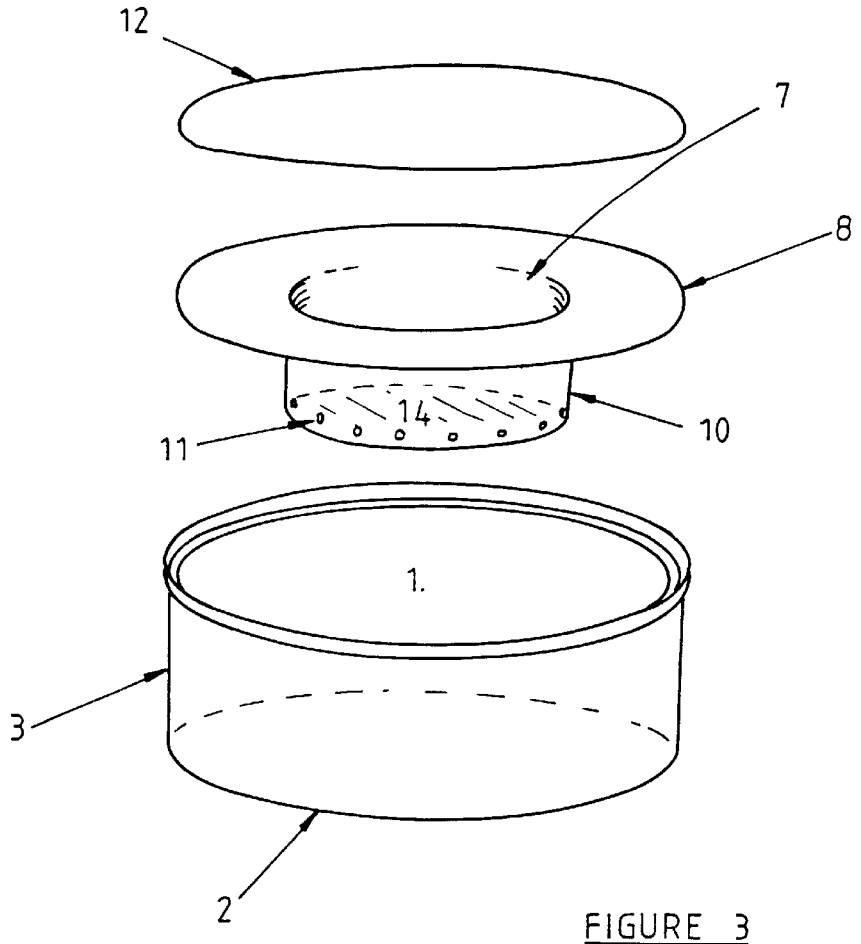
FIG. 3 is an exploded view of a second embodiment of potty in accordance with the present invention.
Figure 4:
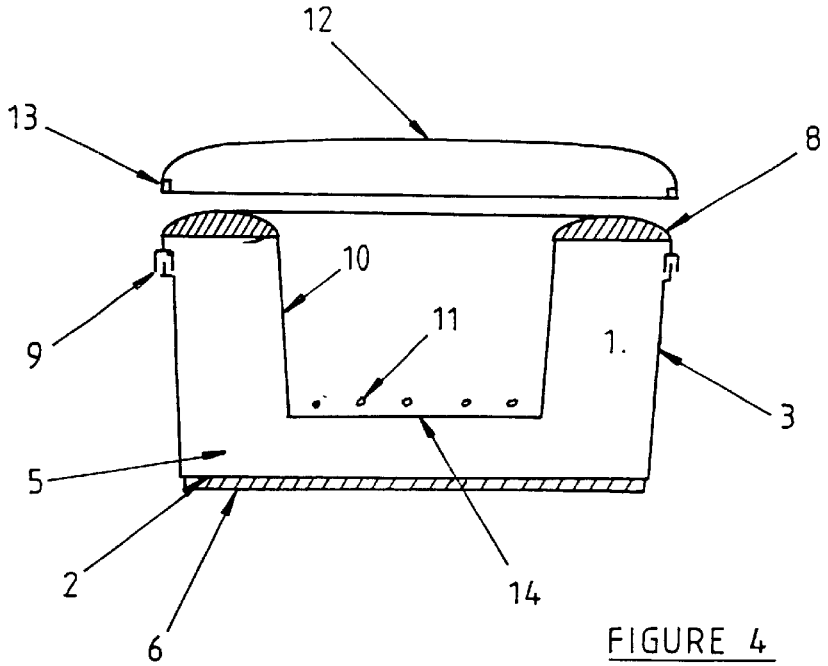
FIG. 4 is a cross-sectional view of the potty of FIG. 3.

Referring to FIGS. 3 and 4 of the drawings, a second embodiment of potty is shown which is simpler to manufacture than that shown in FIGS. 1 and 2 in that the floor 2 has no raised portion. Instead, the cylindrical side wall 10 is provided with a floor 14. The seat 7, comprising its rim 8, cylindrical side wall 10 and floor 14 may be self-supporting on the side wall 3, however legs or posts may be provided for supporting the floor 14 above the floor 2.

It will be appreciated that, whilst the drawings show the apertures 11 formed in the cylindrical side wall 10 of the recessed portion, the apertures 11 could also or otherwise be formed in the floor 14. Also, whilst the potties shown in FIGS. 1 to 4 are substantially cylindrical, they may instead be oval, rectangular, or indeed any desired shape or combination of shapes.

Whilst the potty shown in FIGS. 1 and 2 may be preferred over that shown in FIGS. 3 and 4, in that the raised portion 4 of the former not only provides additional support for the recessed portion, but also acts as a baffle to limit sloshing of the potty contents, it will be appreciated that the latter arrangement may be smaller than the former arrangement yet still provide the same storage capacity. The latter arrangement might therefore be chosen in preference to the former arrangement where the space provided for storing the potty is limited.

A lid 12 is arranged to be fitted to the potty to prevent the escape of noxious odours therefrom following use and prior to the potty being cleaned.

The base container 1, the seat 7 and the lid 12 are each formed from a plastics material, e.g. polypropylene, and are readily separable for cleaning.

Further modifications will be apparent to those skilled in the art without departing from the scope of the present invention.

The potties thus described provide improved containment for liquid excreta by reducing the likelihood of spillage.

What is claimed is:

1. A potty comprising:

a base container having a floor and a side wall extending upwardly from the floor;

a removable seat portion having a rim which is supported on and sealed against the side wall of the base container and which extends inwardly away from the side wall of the base container to form a seat surrounding a recessed portion which extends partially into the base container, the recessed portion being formed with at least one aperture through which liquid may escape from the recessed portion into the base container;

and a removable lid to cover at least the recessed portion, the floor of the base container comprising a raised portion which is arranged to abut the recessed portion of the seat portion to support the latter when the potty is in use.

2. A potty as claimed in claim 1, wherein the floor of the base container is circular and the side wall of the base container is cylindrical.

3. A potty as claimed in claim 2, wherein the rim of the seat is circular.

4. A potty as claimed in claim 1, the base of which is provided with a coating of non-slip material.

5. A potty comprising:

a base container having a floor and a side wall extending upwardly from the floor; and a removable seat portion having a rim which is supported on and sealed against the side wall of the base container and which extends inwardly away from the side wall of the base container to form a seat surrounding a recessed portion which extends partially into the base container, the recessed portion being formed with at least one aperture through which liquid may escape from the recessed portion into the base container, the floor of the base container comprising a raised portion which is arranged to abut the recessed portion of the seat portion to support the latter when the potty is in use.

* * * * *